US005977871A

United States Patent [19]

Miller et al.

[11] Patent Number: 5,977,871

[45] Date of Patent: Nov. 2, 1999

[54] ALARM REPORTING SYSTEM

[75] Inventors: Paul David Miller, Knutsford; Stuart Wood, Stockport, both of United Kingdom

[73] Assignee: AVR Group Limited, Cheshire, United Kingdom

[21] Appl. No.: 09/021,300

[22] Filed: Feb. 10, 1998

[30] Foreign Application Priority Data

Feb. 13, 1997 [GB] United Kingdom ..... 9702900
Oct. 18, 1997 [GB] United Kingdom ..... 9721989

[51] Int. Cl.[6] ..... G08B 25/00

[52] U.S. Cl. ..... 340/506; 340/502; 340/541; 340/577; 340/584; 340/587

[58] Field of Search ..... 340/506, 502, 340/587, 541, 577, 584

[56] References Cited

U.S. PATENT DOCUMENTS 4,227,052 10/1980 Kahn ..... 379/40
5,134,644 7/1992 Garton et al. ..... 379/39
5,812,054 9/1998 Cohen ..... 340/506

FOREIGN PATENT DOCUMENTS

A1-0-133-250 7/1984 European Pat. Off. .

*Primary Examiner*—Glen Swann
*Attorney, Agent, or Firm*—Oliff & Berridge, PLC

[57] ABSTRACT

A controlling interface unit is linked to a plurality of event sensors associated with a premises. There is at least one manner of establishing communication, using wired communication lines or radio transmissions between this interface unit and, on the one hand, a remote alarm receiving center for monitoring the sensors at the premises, and, on the other hand, a remote auxiliary facility for filtering out potential false alarms from those premises. The interface unit is capable of routing signals originating from a selected type of sensor to the auxiliary filtering facility instead of or in addition to transmitting the same signals to the alarm receiving center. Depending on the circumstances, feedback signals may then be transmitted from the auxiliary filtering facility to the controlling interface unit to negate an alarm condition. Optionally, a memory unit may be linked to the controlling interface unit to store data from the event sensors for a limited time period. This data is then transmitted to the auxiliary filtering facility along with any signal from the selected type of sensor to assist in determination of whether the alarm is valid.

6 Claims, 1 Drawing Sheet

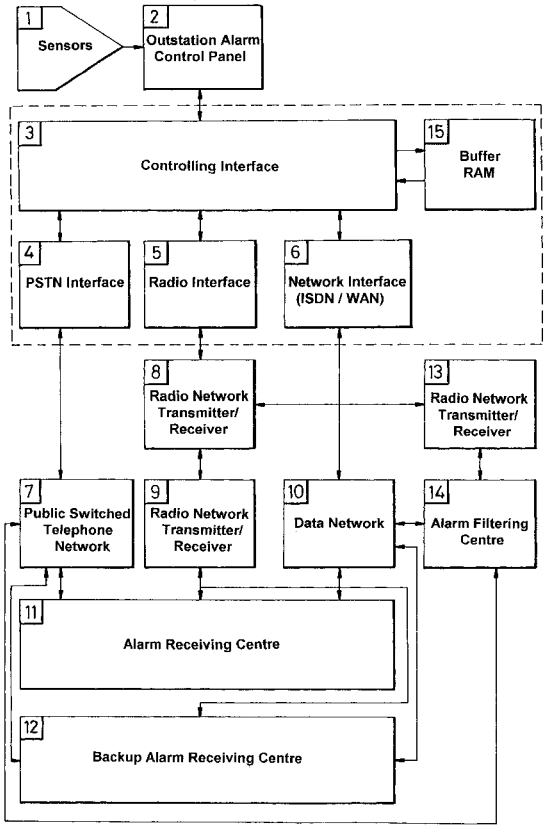

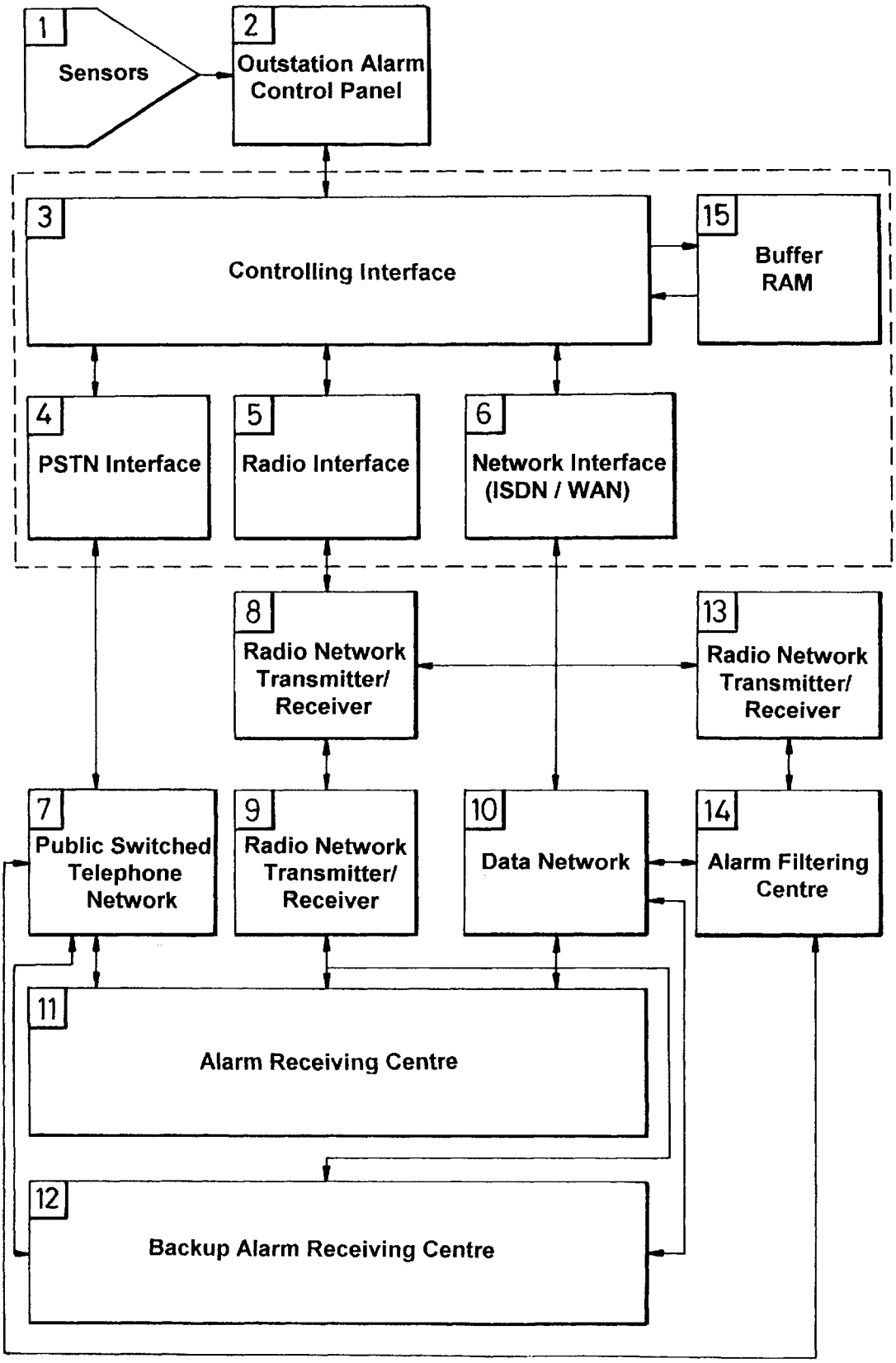
1
Sensors
2
Outstation Alarm Control Panel
3
Controlling Interface
15
Buffer RAM
4
PSTN Interface
5
Radio Interface
6
Network Interface (ISDN / WAN)
8
Radio Network Transmitter/ Receiver
13
Radio Network Transmitter/ Receiver
7
Public Switched Telephone Network
9
Radio Network Transmitter/ Receiver
10
Data Network
14
Alarm Filtering Centre
11
Alarm Receiving Centre
12
Backup Alarm Receiving Centre

ALARM REPORTING SYSTEM

TECHNICAL FIELD

This invention concerns an alarm reporting system whereby a remote alarm receiving centre monitors signals emanating from a plurality of event sensors located at a protected premises.

BACKGROUND ART

Normally, an alarm signal is transmitted directly from the protected premises to a commercial alarm receiving centre. When this signal is received, a manual verification process may commence to try and ascertain whether the signal is false or a true indication of an alarm condition at the premises. The outcome of any such procedure will determine whether the emergency services are informed of the alarm situation.

A significant percentage of alarm conditions relayed to the emergency services via commercial alarm receiving centres prove to be false alarms. In many cases these false alarms result from errors on the part of the alarm system user at the premises, e.g incomplete disarming of an intruder alarm as the premises are opened up at the start of the working day, or inaccuracies in the way in which an intruder alarm is armed at the end of the working day.

In order to more effectively filter these alarms conditions and thus reduce the number of false calls relayed to the emergency services, some organisations (such as banks, building societies, local education authorities), who operate high numbers of alarm sensors at diverse premises have set up their own "in-house" monitoring centres, which are used in place of commercial alarm receiving centres. These in-house alarm monitoring centres use their knowledge concerning the operation of their premises to filter signals more effectively and virtually eliminate false alarms due to user error.

OBJECT OF THE INVENTION

An object of the present invention is to enable the automatic transmission of selected alarm conditions emanating from a protected premises to an alarm filtering centre operated by or on behalf of an organisation which owns or is responsible for the protected premises.

SUMMARY OF THE INVENTION

The invention proposes an alarm reporting system comprising a controlling interface unit linked to a plurality of event sensors associated with a premises, and at least one means of establishing communication, using wired communication lines or radio transmissions, between this interface unit and, on the one hand, a remote alarm receiving centre for monitoring the sensors at the premises, and, on the other hand, a remote auxiliary facility for filtering out potential false alarms from those premises, the interface unit being capable of routing signals originating from a selected type of sensor to the auxiliary filtering facility instead of or in addition to transmitting the same signals to the alarm receiving centre.

Use of the auxiliary filtering facility allows the organisation responsible for the premises to implement its own verification procedures and identify false alarms created by their own personnel.

In a preferred embodiment of the system, the controlling interface unit routes signals originating from a selected type of sensor to the auxiliary filtering facility in addition to transmitting the same signals to the alarm receiving centre. The filtering facility has a short time period, of the order of a few minutes at most, to ascertain whether the signal is likely to be a false alarm. If it is deemed to be so, it will transmit a signal back to the interface unit effectively instructing cancellation of the alarm condition. The interface unit will then communicate this forthwith to the alarm receiving centre so that no action is taken to notify the emergency services. Obviously, if no such "cancellation" instruction is received within a predetermined period, the alarm receiving centre will automatically proceed to contact the emergency services.

In an alternative embodiment of the system of the invention, the controlling interface unit may route signals originating from a selected type of sensor to the auxiliary filtering facility instead of transmitting them to the alarm receiving centre. The alarm filtering centre may then prevent transmission of the alarm to the alarm receiving centre and onward to the emergency services by transmitting a signal back to the interface unit which effectively cancels the alarm condition. Failure to do this, i.e. confirm the alarm as false, within a pre-determined time will lead to automatic transmission of the alarm signal to the commercial alarm receiving centre.

Where the alarm signal is not one of a type to which filtering should be applied, for example, a fire signal, the alarm will always be transmitted directly to the commercial alarm receiving centre and will not be capable of cancellation.

The controlling interface unit may be linked to the alarm receiving centre and to the auxiliary filtering facility by way of any or all of the public switched telephone network (PSTN), a radio communication network, a private data network, or a public data network, such as the integrated services digital network (ISDN) currently provided by British Telecom, or other service provider in each case. In this respect, different means of communication may be used when the interface unit is transmitting signals to the alarm receiving centre and to the auxiliary filtering facility, respectively. In the preferred system, outlined above, such different means of communication may be employed simultaneously, or substantially so.

Conventionally, all events detected by or relating to the sensors associated with a particular premises, e.g. the arming or disarming of an intruder alarm system, or partial arming or disarming of same, as well as signals indicative of intrusion, fire or personal attack, are notified to the commercial alarm receiving centre by way of the PSTN for a fixed annual fee paid by the organisation responsible for the premises to the provider of the PSTN.

In many cases, where the system of the invention is employed, it will be advantageous to use the ISDN for communication between the controlling interface unit and the auxiliary filtering facility. Since the charges for use of this network depend on the number of connections made, it could prove costly to communicate all events to the auxiliary filtering facility in the same way as to the alarm receiving centre. However, other events, such as the arming or disarming, or partial arming or disarming of an intruder detection system at the premises are likely to prove important in the assessment of whether the alarm condition is justified which has to be made at the auxiliary filtering facility.

With this in mind, a particularly advantageous embodiment of the system of the invention further comprises a memory unit linked to the controlling interface unit and adapted to store data from the event sensors for a limited time period, said memory being accessible by the controlling interface unit, which transmits said data to the auxiliary filtering facility along with any signal from the selected type of sensor.

Such a memory unit may comprise a random access memory which will serve as a moving time (transient) memory, storing data, along with time references, for a short period e.g. 90 seconds, 2 minutes or thereabouts. Then, whenever an event appertaining to a potential alarm is reported to the auxiliary filtering facility, this stored data is transmitted too to assist in determination of whether the alarm is valid.

A further option would be for the memory unit additionally to store data for a short fixed time period subsequent to transmission of a potential alarm signal to the auxiliary filtering facility, which data would then be accessed and communicated to the filtering facility by the controlling interface unit via a separate connection at the end of that predetermined period.

BRIEF DESCRIPTION OF DRAWING

The invention will be described further, by way of example, with reference to the accompanying drawing in which the single FIGURE is a block diagram of an alarm reporting system in accordance with the invention in use within a wider signal handling arrangement.

DETAILED DESCRIPTION OF PREFERRED EMBODIMENT

The illustrated system comprises a controlling interface unit (3) linked to respective interfaces (4), (5) and (6) to a public telephone network (7), to a radio communication network (8), (9) and (13), and to a data network (10), which in this case is indicated as being the public integrated services digital network (ISDN), but could alternatively be a private data network. The controlling interface unit (3) controls communication to and from a plurality of sensors (1) at a local premises and also to and from an alarm receiving centre (11) and to and from an alarm filtering centre (14) via one or more types of data path.

The sensors (1), such as intruder alarm sensors, personal attack sensors or fire detection sensors, at the local premises convey information to an alarm control panel (2) acting as a local terminal linked to the controlling interface unit (3). When an event is to be reported to a remote central facility, the panel (2) signals to the controlling interface unit (3). Depending upon the type of event to which the signal relates the controlling interface unit (3) will either send the signal only to the alarm receiving centre (11), or to both the alarm receiving centre (11) and the alarm filtering centre (14).

For example, signals relating to routine events such as the switching on and off of an intruder detection system may be sent only to the alarm receiving centre (11). Fire or personal attack alarm signals, where there is a risk to life, will be communicated to the alarm receiving centre (11) and optionally also to the filtering centre (14). In the latter case this will be only for logging purposes so that the owner or person/organisation responsible for the premises can have a full record of all alarm signals. An intruder alarm signal, which frequently results from user error, will be transmitted to both the alarm receiving centre (11) and the alarm filtering centre (14), so that at the latter facility its veracity can be checked.

If the alarm filtering centre (14) transmits a cancellation signal back to the controlling interface (3) within a defined period of time, for example two minutes, the controlling interface (3) will send on a corresponding cancellation signal to the alarm receiving centre (11), which will not then follow the customary procedure of notifying the police. Naturally, when an alarm signal is not cancelled by the alarm filtering centre (14), within the predetermined time period allowed, the alarm receiving centre (11) will follow its normal procedure and alert the authorities.

As illustrated, a memory unit (15) is linked to the controlling interface (3). This memory (15) stores data from the event sensors (1) for only a relatively short time period. It is accessed by the controlling interface (3) and its contents are transmitted to the alarm filtering centre (14) whenever there is any signal from the selected type of sensor also being transmitted to the alarm filtering centre (14).

The memory unit (15) comprises a random access memory which serves as a moving time (transient) memory, storing data, along with time references, for a short period e.g. 90 seconds, 2 minutes or thereabouts. Whenever an event appertaining to a potential alarm is reported to the alarm filtering centre (14) this stored data is transmitted too to assist in determination of whether the alarm is valid.

A further option is for the memory (15) additionally to store data for a short fixed time period subsequent to transmission of a potential alarm signal to the alarm filtering centre (14), which data is then accessed and communicated to the filtering centre (14) by the controlling interface (3) via a separate connection at the end of that predetermined period.

The features of the system described in our earlier specification GB 9611054 may also be incorporated in this system. Thus, depending on the current status of the signalling paths, the controlling interface (3) may send the signal via the network (4), (5) or (6). If the alarm receiving centre (11), or alarm filtering centre (14) do not acknowledge the signal via the appropriate path within a defined time, the signal will be transmitted again over the next available path. All paths should have dual receiving devices. If any signal path fails the relevant interface (4), (5) or (6) will use the alternate.

Also, the controlling interface unit (3) may send, via network interfaces (5) and (6), periodic test signals to provide constant monitoring of those signalling paths. The intervals between test signals may be varied depending on the state of the interface signals. This feature allows for more frequent line tests where the risk of the premises warrants closer management of the line quality. For example, when the alarm sensors are switched off in daytime, the polling frequency may be as low as once per hour or per two hours, whereas when the alarm sensors are switched on at night, it may be increased to once per minute or similar.

Receiving devices (7) and/or (9) and/or (10) and/or (13) send their signals to the alarm receiving centre (11). Again the signals must be acknowledged. If they are not, they are sent to a backup alarm receiving centre (12). The backup alarm receiving centre (12) is required in order to reduce losses in the event of a catastrophic systems failure.

Each signal path is bi-directional. Therefore it is possible to send command information to the controlling interface unit (3) with the intention of controlling the equipment (2) at the local premises. Access to the data networks (9), (10) and (13) provides the ability to remotely configure the equipment at the local premises from the alarm filtering centre.

To prevent substitution of the controlling interface (3), a unique signature is set up between the controlling interface (3) and the alarm receiving centre (11) and between the controlling interface (3) and the alarm filtering centre (14) during the commissioning phase. This would make it difficult to eavesdrop or transmit fraudulent data.

Depending upon the type of event to which the signal relates the controlling interface unit (3) may send the signal either to the alarm receiving centre (11), or to the alarm filtering centre (14).

For example, a fire or personal attack alarm signal, where there is a risk to life, will be sent directly to the alarm receiving centre (11), whereas an intruder alarm signal, which frequently results from user error, will be initially transmitted to the alarm filtering centre (14), so that its veracity can be checked.

Signals which are transmitted directly to the alarm receiving centre (11) may also be transmitted to the filtering centre (14), but only for logging purposes so that a full record of all alarm signals is maintained, where desired.

If the alarm signal is sent initially solely to the alarm filtering centre (14) and a cancellation signal is not transmitted back to the controlling interface (3) within a defined period of time, for example two minutes, the controlling interface (3) will send the alarm signal to the alarm receiving centre (11), which will almost invariably notify the police. When an alarm signal is cancelled by the alarm filtering centre (14), the controlling interface (3) will send notification of the cancellation to the alarm receiving centre (11).

In order to make such a system cost-effective, yet still filter out the majority of false alarm signals, it may be desirable that the alarm filtering centre (14) should only be operational during periods of peak signal activity (e.g. 8 am to 10 am and 4 pm to 7 pm). Provision also needs to be made for shut down of the alarm filtering centre in the event that insufficient staff are available e.g. owing to sickness or holidays. Therefore, the controlling interface unit (3) may be programmed so that during predetermined periods of each day, or for any given period, as required, each reported alarm condition is immediately transmitted by the controlling interface (3) to the alarm receiving centre (11). This facility ensure that there are no delays in processing alarm signals where the alarm filtering centre is inoperative. The programming of the interface unit (3) to pass all signals to the alarm receiving centre (11) for predetermined periods or an indefinite period is preferably undertaken from the alarm filter centre (14).

In other respects, this alternative system would be as already described with reference to the drawing.

We claim:

1. An alarm reporting system comprising a controlling interface unit linked to a plurality of event sensors associated with a premises, and at least one means of establishing communication, using wired communication lines or radio transmissions, between this interface unit and, on the one hand, a remote alarm receiving centre for monitoring the sensors at the premises, and, on the other hand, a remote auxiliary facility for filtering out potential false alarms from those premises, the interface unit being capable of routing signals originating from a selected type of sensor to the auxiliary filtering facility in addition to transmitting the same signals to the alarm receiving centre, and is further capable of receiving feedback signals from the auxiliary filtering facility negating an alarm condition and transmitting such signals on to the alarm receiving centre.

2. An alarm reporting system as set forth in claim 1 wherein the interface unit is capable of routing signals originating from a selected type of sensor to the auxiliary filtering facility and to the alarm receiving centre using different means of communication in each case.

3. An alarm reporting system as set forth in claim 1 further comprising a memory unit linked to the controlling interface unit and adapted to store data from the event sensors for a limited time period, said memory being accessible by the controlling interface unit, which transmits said data to the auxiliary filtering facility along with any signal from the selected type of sensor.

4. An alarm reporting system comprising a controlling interface unit linked to a plurality of event sensors associated with a premises, and at least one means of establishing communication, using wired communication lines or radio transmissions, between this interface unit and, on the one hand, a remote alarm receiving centre for monitoring the sensors at the premises, and, on the other hand, a remote auxiliary facility for filtering out potential false alarms from those premises, the interface unit being capable of routing signals originating from a selected type of sensor to the auxiliary filtering facility instead of transmitting the same signals to the alarm receiving centre, but is also capable, in the absence of feedback from the auxiliary filtering facility within a predetermined time period, of subsequently transmitting the same signal to the alarm receiving centre.

5. An alarm reporting system as set forth in claim 4 wherein the interface unit is capable of routing signals originating from a selected type of sensor to the auxiliary filtering facility and to the alarm receiving centre using different means of communication in each case.

6. An alarm reporting system as set forth in claim 4 further comprising a memory unit linked to the controlling interface unit and adapted to store data from the event sensors for a limited time period, said memory being accessible by the controlling interface unit, which transmits said data to the auxiliary filtering facility along with any signal from the selected type of sensor.

* * * * *

UNITED STATES PATENT AND TRADEMARK OFFICE

CERTIFICATE OF CORRECTION

PATENT NO. : 5,977,871

DATED : November 2, 1999

INVENTOR(S) : Paul David Miller and Stuart Wood

It is certified that error appears in the above-identified patent and that said Letters Patent is hereby corrected as shown below:

On the cover page, line [73], change "Assignee: AVR Group Limited, Cheshire, United Kingdom" to --Assignee: Monitoring Technologies Limited, Cheshire, United Kingdom--

Signed and Sealed this

Eleventh Day of April, 2000

*Attest:*

*Attesting Officer*

Q. TODD DICKINSON

*Director of Patents and Trademarks*